US006747200B2

(12) United States Patent
Sato

(10) Patent No.: US 6,747,200 B2
(45) Date of Patent: Jun. 8, 2004

(54) HIGH HAT CYMBAL STAND

(75) Inventor: Naoki Sato, Seto (JP)

(73) Assignee: Hoshino Gakki Co. Ltd. (JP)

( * ) Notice: Subject to any disclaimer, the term of this patent is extended or adjusted under 35 U.S.C. 154(b) by 0 days.

(21) Appl. No.: 10/235,607

(22) Filed: Sep. 4, 2002

(65) Prior Publication Data

US 2003/0094089 A1 May 22, 2003

(30) Foreign Application Priority Data

Nov. 16, 2001 (JP) ..... 2001-351165

(51) Int. Cl.[7] ..... G10C 3/12
(52) U.S. Cl. ..... 84/422.3; 84/422.1; 84/422.2
(58) Field of Search ..... 84/422.1, 422.2, 84/422.3

(56) References Cited

U.S. PATENT DOCUMENTS 3,930,431 A * 1/1976 Magadini ..... 84/422.1
4,449,440 A * 5/1984 Hoshino ..... 84/422.3
5,044,249 A * 9/1991 Hoshino ..... 84/422.3
5,192,822 A * 3/1993 Hoshino ..... 84/422.3
6,259,012 B1 * 7/2001 Hoshino ..... 84/422.1
6,359,205 B1 * 3/2002 Lombardi ..... 84/422.1
6,570,076 B1 * 5/2003 Kjellgren ..... 84/422.1

* cited by examiner

*Primary Examiner*—Kimberly Lockett
(74) *Attorney, Agent, or Firm*—Ostrolenk, Faber, Gerb & Soffen, LLP

(57) ABSTRACT

A high hat stand that facilitates adjustment of the height of a distal end of a pedal. The high hat stand includes a fixed body fixed to a gate frame and a movable body fastened to the fixed body. The height of the distal end of the foot pedal is adjusted in accordance with the fastened amount of the fixed body and the movable body. A pair of clamping plates, which are formed integrally with the fixed body, are fastened to each other by a bolt to prohibit rotation of the movable body and determine the height of the distal end of the foot pedal.

21 Claims, 9 Drawing Sheets

HIGH HAT CYMBAL STAND

BACKGROUND OF THE INVENTION

The present invention relates to a high hat cymbal stand that facilitates adjustment of the height of a foot pedal.

FIG. 8 shows a first example of a prior art high hat stand 101. The high hat stand 101 has a height adjustment mechanism 102, which a player uses to adjust the height of the distal end of a foot pedal 103. The height adjustment mechanism 102 includes two parallel rods 104, which are pivotally connected to the upper end of the foot pedal, and rod holding plates 105, 106, which movably hold the two rods 104. The rod holding plate 105 is connected to a connecting member 107. The rods 104, the rod holding plate 105, and the rod holding plate 106 are made of metal such as steel. The connecting member 107 is connected to an operating rod 108, which moves a movable cymbal (not shown) by means of a stopper 112. The operating rod 108 extends through a shock absorber 114, which is mounted on the upper portion of the stopper 112, and a body pipe 110, which is fixed to a stand body 113. A spring 109, which is retained in the body pipe 110, urges the operating rod 108 upward. This, in turn, urges the distal end of the foot pedal 103, the height adjustment mechanism 102, the connecting member 107, the stopper 112, the shock absorber 114, and the cymbal upward. Thus, when the player is not depressing the foot pedal 103, the shock absorber 114 is forced against the lower end of the body pipe 110.

As shown in FIG. 9, the rod holding plate 105 has two threaded holes 105*a*. The rod holding plate 106 has two through holes 106*a*. The two bolts 111 are inserted through the through holes 106*a* and fastened with the threaded holes 105*a*. To adjust the height of the distal end of the foot pedal 103, the rods 104 are first moved to adjust the height of the distal end of the foot pedal 103. Then, the two bolts 111 are fastened. This fastens the two rods 104 to the rod holding plates 105, 106.

FIG. 11 is a second example of a prior art high hat stand 121 having a height adjustment mechanism 122, which is a modification of the height adjustment mechanism 102 employed in the high hat stand 101 of FIG. 8. The height adjustment mechanism 122 includes a first height adjustment plate 124, which is connected to the connecting member 107, and a second height adjustment plate 126, which is pivotally connected to the foot pedal 103. The first and second height adjustment plates 124, 126 are made of metal such as steel.

The first and second adjustment plates 124, 126 respectively have serrated surfaces 124*a*, 126*a* (see FIG. 10). The height adjustment plates 124, 126 are fastened to each other by a bolt 130 and a nut 131 in a state in which the serrated surfaces 124*a*, 126*a* are meshed with each other. To adjust the height of the distal end of the foot pedal 103, the bolt 130 and nut 131 are loosened. Then, the bolt 130 is moved along an elongated hole 124*b* of the height adjustment plate 124 to change the position where the serrated surfaces 124*a*, 126*a* are meshed with each other. When the serrated surfaces 124*a*, 126*a* are arranged at the desired position, the bolt 130 and nut 131 are fastened with each other to fix the height adjustment plates 124, 126.

However, when using the height adjustment mechanism 102 of the high hat stand 101 shown in FIG. 8, it is difficult to find the optimal position of the foot pedal 103. More specifically, the foot pedal 103 is adjusted to various heights and depressed at each height to find the optimal position.

Since the bolts 111 must be fastened each time the distal end height of the foot pedal 103 is adjusted, the adjustment is burdensome. Further, when fastening the bolts 111, the rods 104 may move downward due to its own weight. This may cause difficulty in positioning the distal end of the foot pedal 103 at the intended position.

The high hat stand 121 employing the height adjustment mechanism 122 of FIG. 11 also has the same problem.

SUMMARY OF THE INVENTION

It is an object of the present invention to provide a high hat stand that facilitates height adjustment of a pedal.

To achieve the above object, the present invention provides a high hat cymbal stand including a stand body for supporting a cymbal, a pedal operated to move the cymbal, and an adjustment mechanism arranged between the stand body and the pedal to adjust the height of a distal end of the pedal. The adjustment mechanism includes a temporary positioning mechanism for temporarily positioning the distal end of the pedal at a certain height and a lock mechanism for locking and unlocking the temporary positioning mechanism.

A further perspective of the present invention is a high hat cymbal stand including a stand body for detachably supporting two cymbals, a pedal attached to the stand body and moved within a stroke defined by an initial position in which the two cymbals are separated from each other and an operation position in which the two cymbals contact each other, and an adjustment mechanism attached to the stand body to adjust the initial position of the pedal and change the stroke. The adjustment mechanism includes a temporary positioning mechanism operated to temporarily position the pedal at the initial position and a lock mechanism operated to lock the temporary positioning mechanism. The operation of the temporary positioning mechanism is prohibited when the temporary positioning mechanism is locked. The operation of the temporary positioning mechanism is permitted when the temporary positioning mechanism is unlocked. The initial position of the pedal is adjusted by operating the temporary positioning mechanism.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
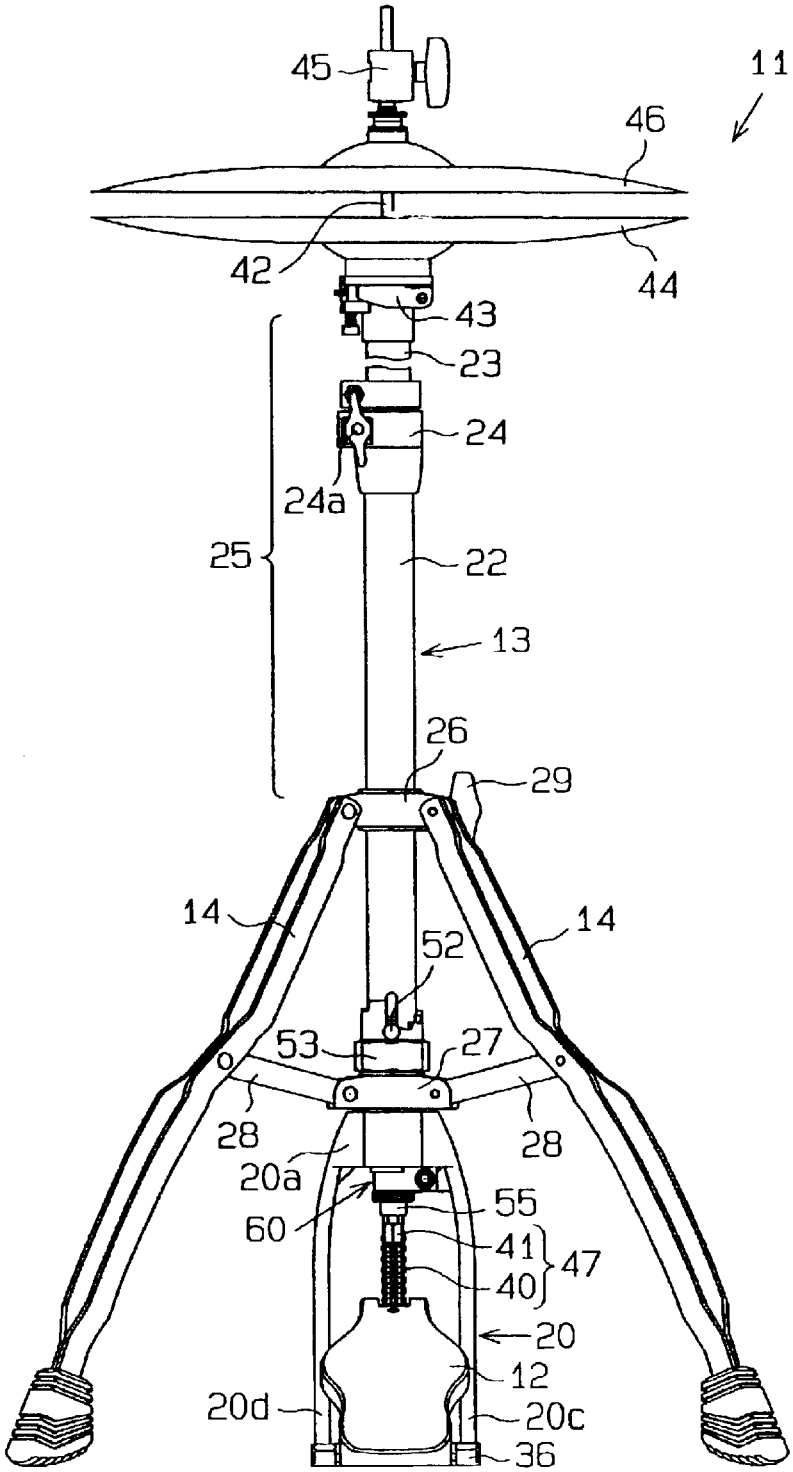
FIG. 1 is a front view showing a high hat stand according to a preferred embodiment of the present invention.

A high hat stand 11 according to a preferred embodiment of the present invention will now be discussed. FIG. 1 is a front view of the high hat stand 11. The front of the plane of FIG. 1 defines the rear side of the high hat stand 11.

The high hat stand 11 has three legs 14, a stand body 13 for supporting two cymbals 44, 46, a gate frame 20 attached to the stand body 13, and a foot pedal 12 supported by the gate frame 20. The height of the stand body 13, or the height of the cymbals 44, 46, is adjusted in accordance with the length of an upper pipe 23, which projects from a lower pipe 22.

Figure 2:
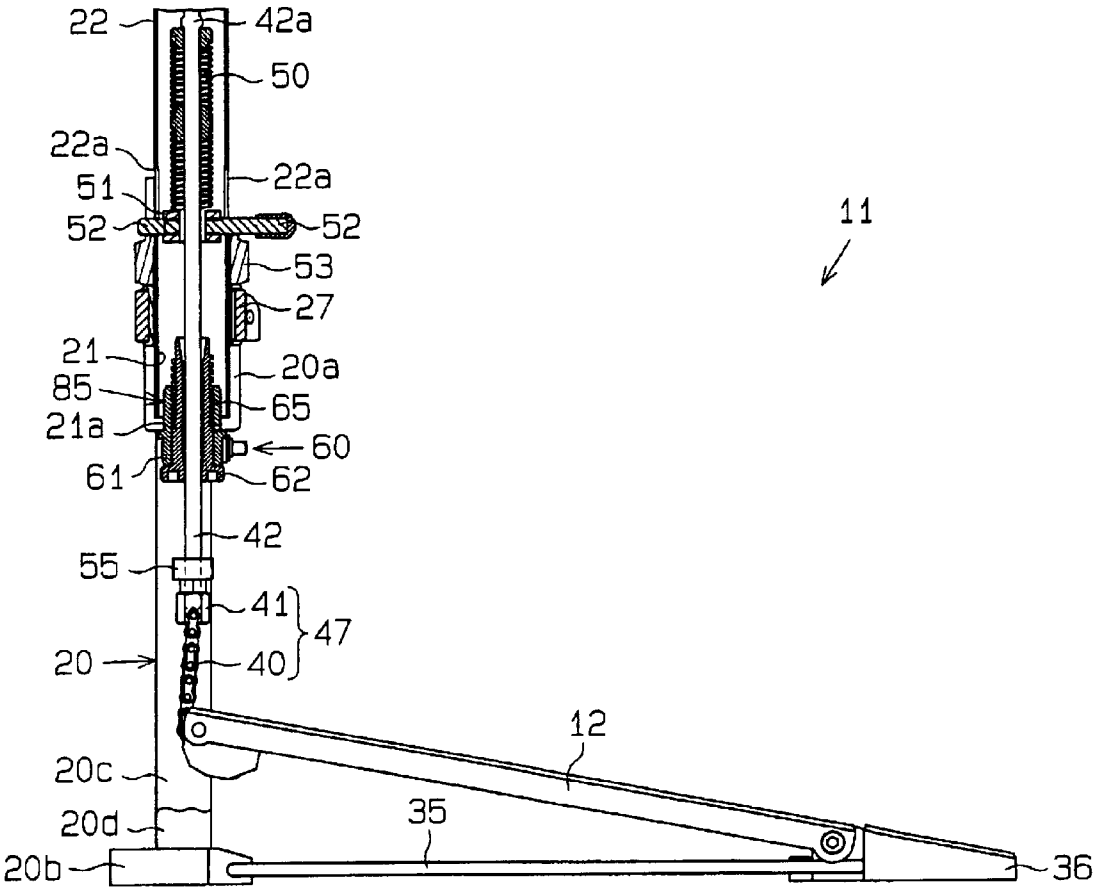
FIG. 2 is a cross-sectional view showing the high hat stand of FIG. 1 in a state in which the pedal is depressed.
Figure 3B:
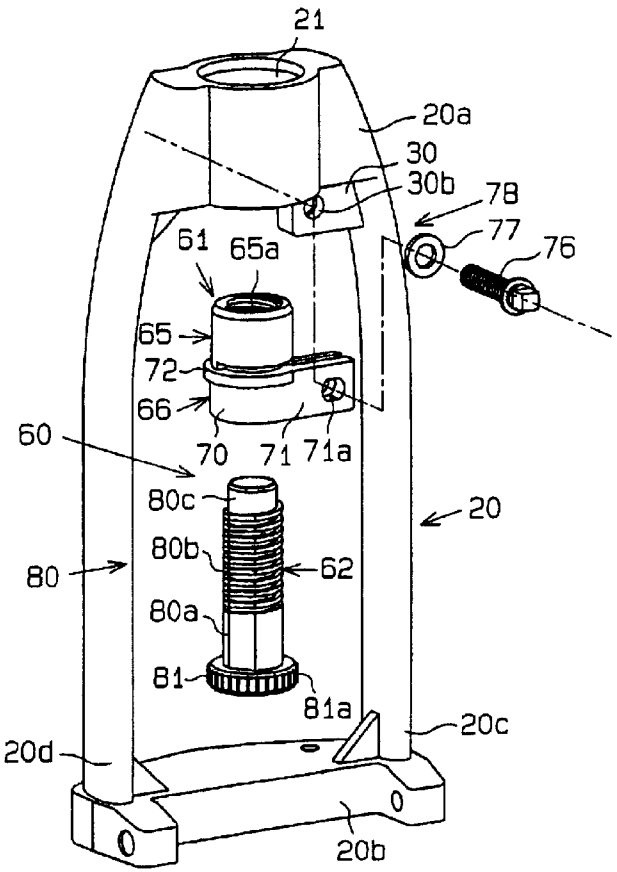
FIGS. 3A and 3B are exploded perspective views showing a gate frame and a height adjustment mechanism of the high hat stand of FIG. 1.
Figure 3A:
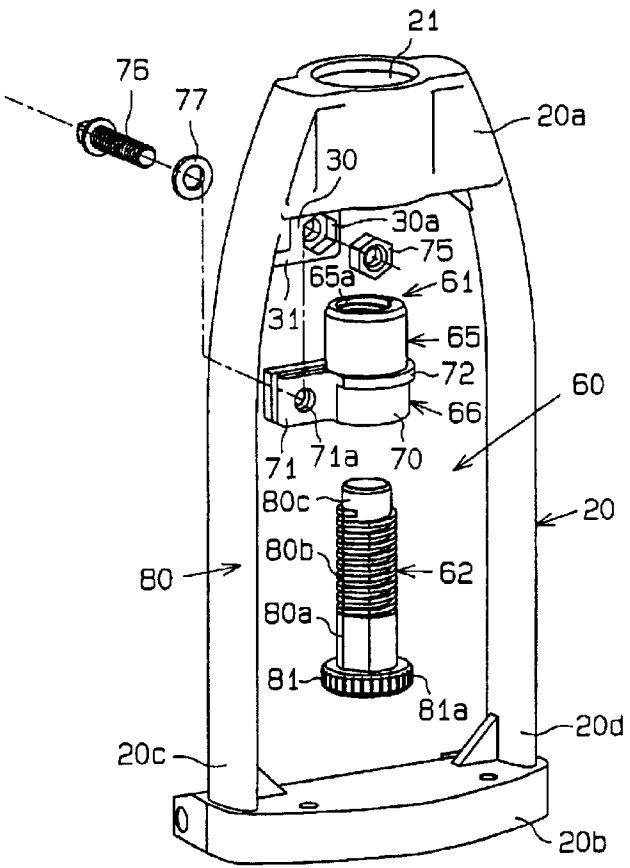
Figure 4:
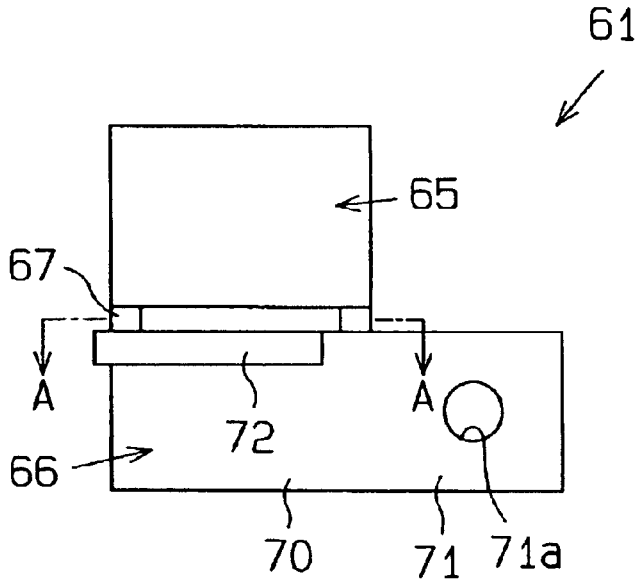
FIG. 4 is a front view showing a fixed body of the high hat stand of FIG. 1.
Figure 5:
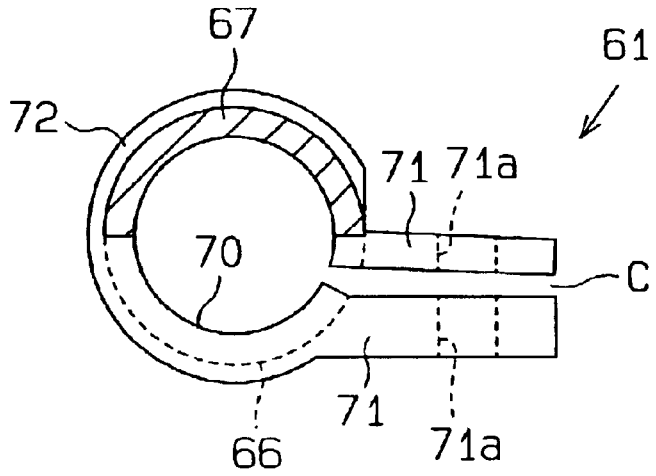
FIG. 5 is a cross-sectional view taken along line 5—5 in FIG. 4.

As shown in FIG. 3A, the gate frame 20 includes an upper piece 20*a*, a lower piece 20*b*, and two bars 20*c*, 20*d*, which connect the upper and lower pieces 20*a*, 20*b*. As shown in FIG. 2, a through hole 21 extends through the upper piece 20*a*. The lower end of the through hole 21 has a reduced diameter that defines a holding portion 21*a*. The lower pipe 22 is inserted in the through hole 21, and the lower end of the lower pipe 22 is held on the holding portion 21*a*.

Referring to FIG. 1, the lower end of the upper pipe 23 in inserted in the lower pipe 22. A fastening mechanism 24 is attached to the upper end of the lower pipe 22 to fasten the upper pipe 23 to the lower pipe 22. The lower pipe 22 and the upper pipe 23 define a pipe unit 25. To move the upper pipe 23 relative to the lower pipe 22, a fastening nut 24*a* of the fastening mechanism 24 is loosened. This enables adjustment of the length of the pipe unit 25.

The three legs 14 (only two shown, one is hidden behind the stand body 13) are pivotally connected to a support 26. A fastener 29 is used to fix the support 26 at a preferred position on the lower pipe 22. The three legs 14 stably hold the high hat stand 11 in an erected state. A stay 28 is pivotally connected to the middle of each leg 14. The three stays 28 are pivotally connected to a support 27, which is fixed to the lower pipe 22.

Referring to FIG. 2, a connecting arm 35, which extends rearward, is pivotally connected to the lower piece 20*b* of the gate frame 20. The connecting arm 35 has a heel portion 36, which pivotally supports the rear end of the foot pedal 12. The front end of the foot pedal 12 is connected to a chain 40, which is further connected to a nut 41. The nut 41 is fastened to the lower end of an operating rod 42. The operating rod 42 is inserted through the holding portion 21*a*, the through hole 21, the lower pipe 22, and the upper pipe 23 (FIG. 1). The upper end of the operating rod 42 projects from the upper pipe 23.

Referring to FIG. 1, a holder 43 fixes the lower cymbal 44, which is fixed, to the upper end of the upper pipe 23. The operating rod 42 extends through the lower fixed cymbal 44 and is connected with the upper cymbal 46, which is movable. More specifically, a holder 45 fixes the upper movable cymbal 46 to the upper end of the operating rod 42. When a player depresses the foot pedal 12, the upper movable cymbal 46 hits the lower fixed cymbal 44. When the player releases the foot pedal 12, the upper movable cymbal 46 moves away from the lower fixed cymbal 44.

As shown in FIG. 2, the operating rod 42 has an upper spring seat 42*a*, the diameter of which is larger than the other portions of the operating rod 42. A spring 50, or urging member, is fitted on the operating rod 42. The upper end of the spring 50 is engaged with the upper spring seat 42*a*. The lower end of the spring 50 is engaged with a lower spring seat 51, which is arranged on the operating rod 42.

The lower spring seat 51 has a pin 52, which is perpendicular to the axis of the operating rod 42. The pin 52 extends out of the lower pipe 22 through a slit 22*a*, which extends parallel to the axis of the lower pipe 22. A tension adjuster 53, which adjusts the height of the pin 52 at multiple levels, is attached to the lower pipe 22.

The spring 50 urges the upper spring seat 42*a* and the pin 52 away from each other. The tension adjuster 53 restricts the downward movement of the pin 52. Thus, the spring 50 upwardly urges the spring seat 42*a*, or the operating rod 42.

A shock absorber 55, which absorbs shocks, is attached to the operating rod 42 above the nut 41. The shock absorber 55 is annular and formed from synthetic rubber. A height adjustment mechanism 60 is arranged in the through hole 21 of the upper piece 20*a*. Since the spring 50 urges the operating rod 42 upward, the shock absorber 55 is normally pressed against the lower surface of the height adjustment mechanism 60.

The pipe unit 25, the chain 40, the nut 41, the operating rod 42, the spring 50, and the shock absorber 55 form the stand body 13.

When the tension adjuster 53 holds the pin 52 at a high position, the distance between the upper spring seat 42*a* and the lower spring seat 51 decreases. This increases the reaction force of the spring 50, which, in turn, increases the force required to depress the foot pedal 12. On the other hand, when the tension adjuster 53 holds the pin 52 at a low position, the upper spring seat 42*a* and the lower spring seat 51 move away from each other. This reduces the reaction force of the spring 50. Thus, the force required to depress the foot pedal 12 decreases.

The height adjustment mechanism 60 will now be described in detail.

Referring to FIGS. 3A and 3B, the height adjustment mechanism 60 includes a hollow fixed body 61 and a movable body 62. The lower end of the movable body 62 engages the shock absorber 55 (FIG. 2). The fixed body 61 and the movable body 62 are formed from synthetic resin. The operating rod 42 is inserted through the fixed body 61 and the movable body 62. The fixed body 61 includes a female thread body, or threaded sleeve 65, a clamp 66, which is arranged under the threaded sleeve 65, and a coupler 67, which connects an arcuate portion of the threaded sleeve 65 and an arcuate portion of the clamp 66.

The threaded sleeve 65 is inserted in the through hole 21 of the upper piece 20*a*. The threaded sleeve 65 has square female threads 65*a* (refer to FIGS. 2 and 3A). The clamp 66 includes a C-like ring 70 and a two opposed clamping plates 71, which are spaced from each other by clearance C. A flange 72, which engages the holding portion 21*a*, is formed on the upper end of the ring 70. The inner diameter of the ring 70 decreases when the two clamping plates 71 are fastened to each other. Each clamping plate 71 has a hole 71*a* for receiving a bolt 76.

As shown in FIGS. 3A and 3B, a holding plate 30 is formed integrally with the gate frame 20 between the upper piece 20*a* and the bar 20*c*. A hexagonal hole 30*a* is formed in the front surface 31 of the holding plate 30. A nut 75 is accommodated in the hexagonal hole 30*a*. The hexagonal hole 30*a* restricts the rotation of the nut 75. The holding plate 30 has a hole 30*b* for receiving the threaded portion of the bolt 76.

The two clamping plates 71 are arranged near the rear surface of the holding plate 30. The bolt 76, which is inserted through a washer 77, the two holes 71*a*, and the hole 30*b*, is fastened with the nut 75. As a result, the fixed body 61 is fixed to the gate frame 20. The clamp 66, the bolt 76, and the nut 75 define a rotation restriction mechanism 78, or a lock mechanism.

The movable body 62, which serves as a male thread body, includes a cylindrical shaft 80 and a knob 81, which is formed on the lower end of the shaft 80. The shaft 80 includes a tightening portion 80*a*, a threaded portion 80*b*, and an inserting portion 80*c*. The outer diameter of the tightening portion 80*a* is slightly smaller than the inner diameter of the ring 70. The threaded portion 80*b* has square male threads, which are meshed with the square female threads of the threaded sleeve 65. The outer diameter of the threads of the threaded portion 80*b* is about the same as the outer diameter of the tightening portion 80*a*. The outer diameter of the inserting portion 80*c* is about the same as the diameter of the valleys of the threaded portion 80*b*. A knurl 81*a* is formed on the outer surface of the knob 81 to aid gripping.

The fastening of the bolt 76 and the nut 75 reduces clearance C, which is the space between the two clamping plates 71. Thus, the ring 70 fixes and restricts the rotation of the movable body 62. The threaded sleeve 65 and the movable body 62 define a temporary positioning mechanism 85.

Figure 6:
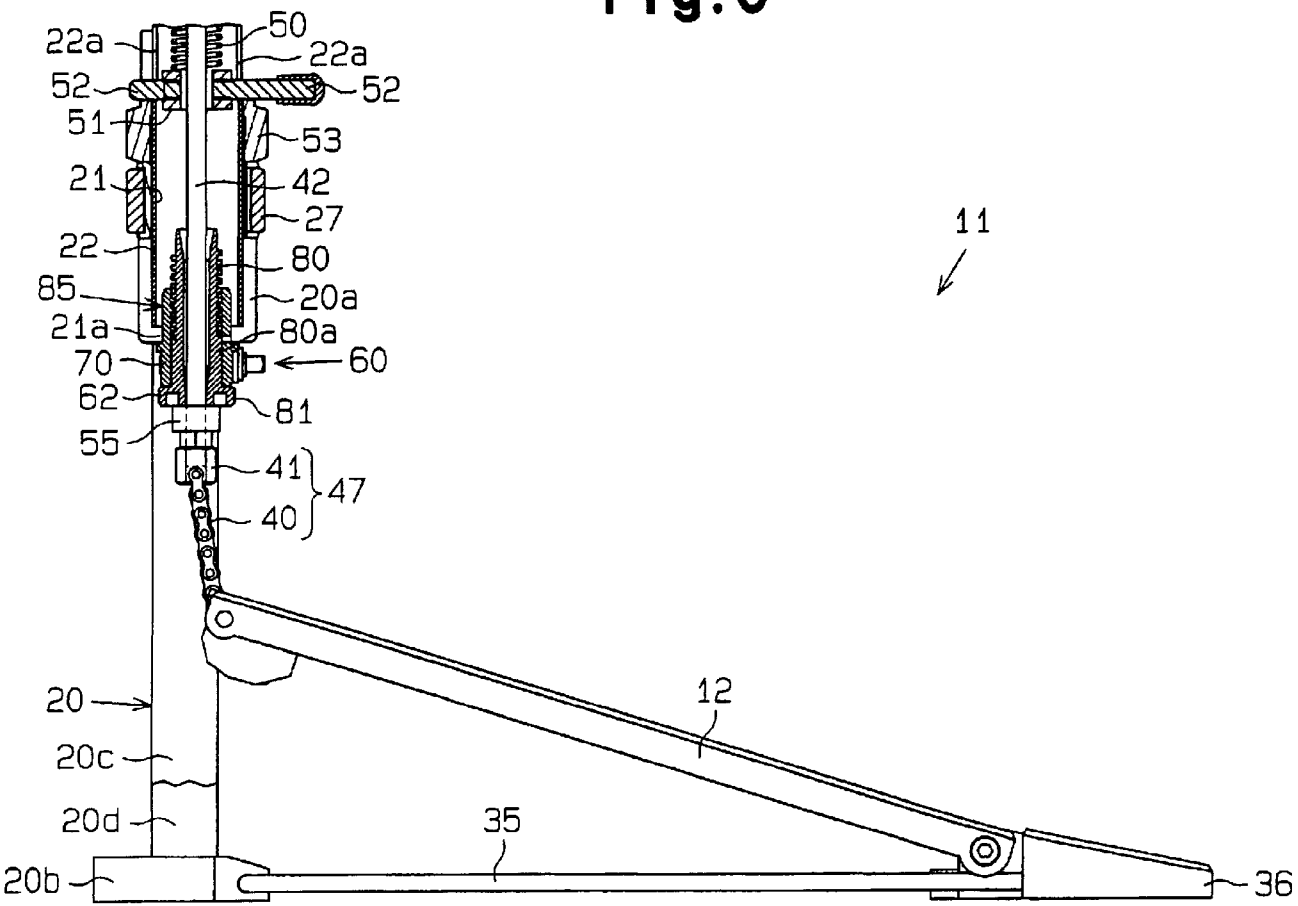
FIG. 6 is a cross-sectional view showing the high hat stand in a state in which the pedal is not depressed.
Figure 7:
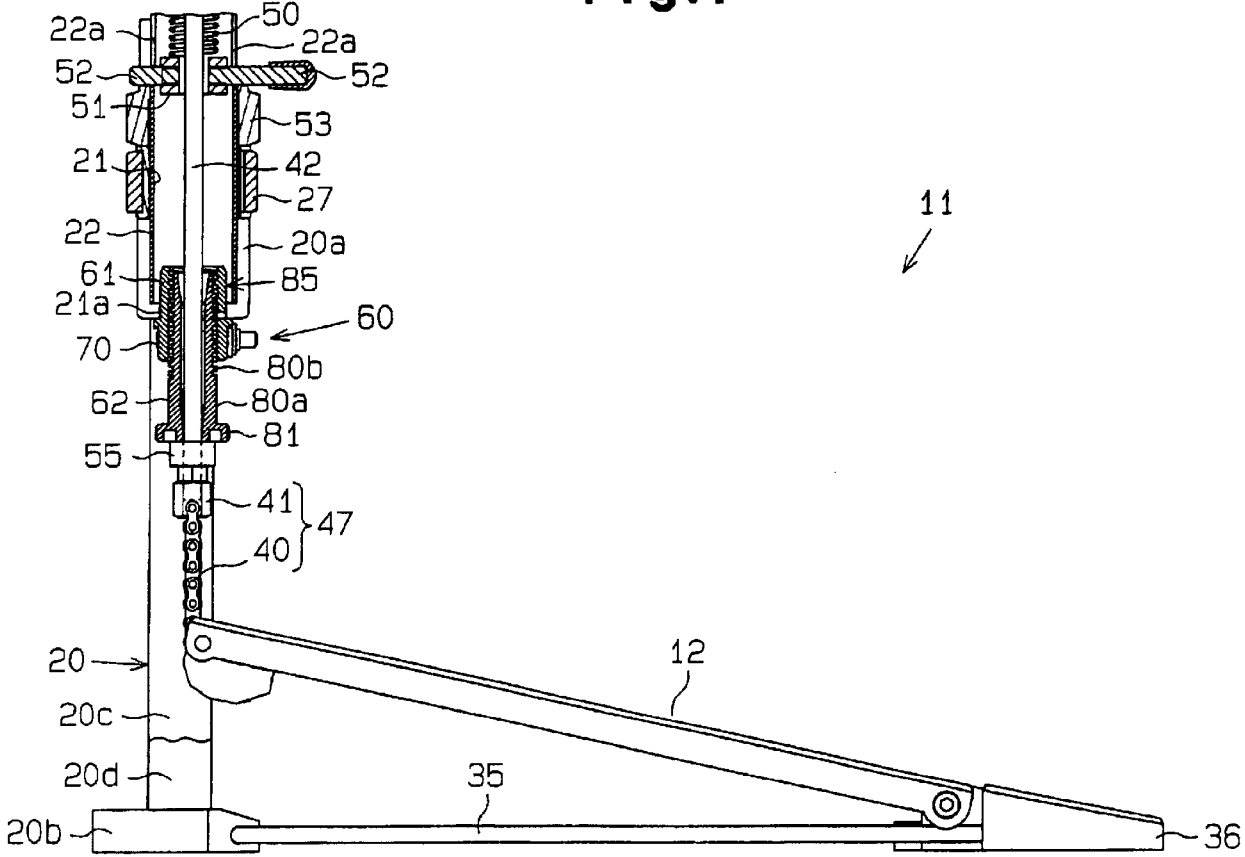
FIG. 7 is a cross-sectional view showing the high hat stand in a state in which an adjustment knob is arranged at a low position.
Figure 8:
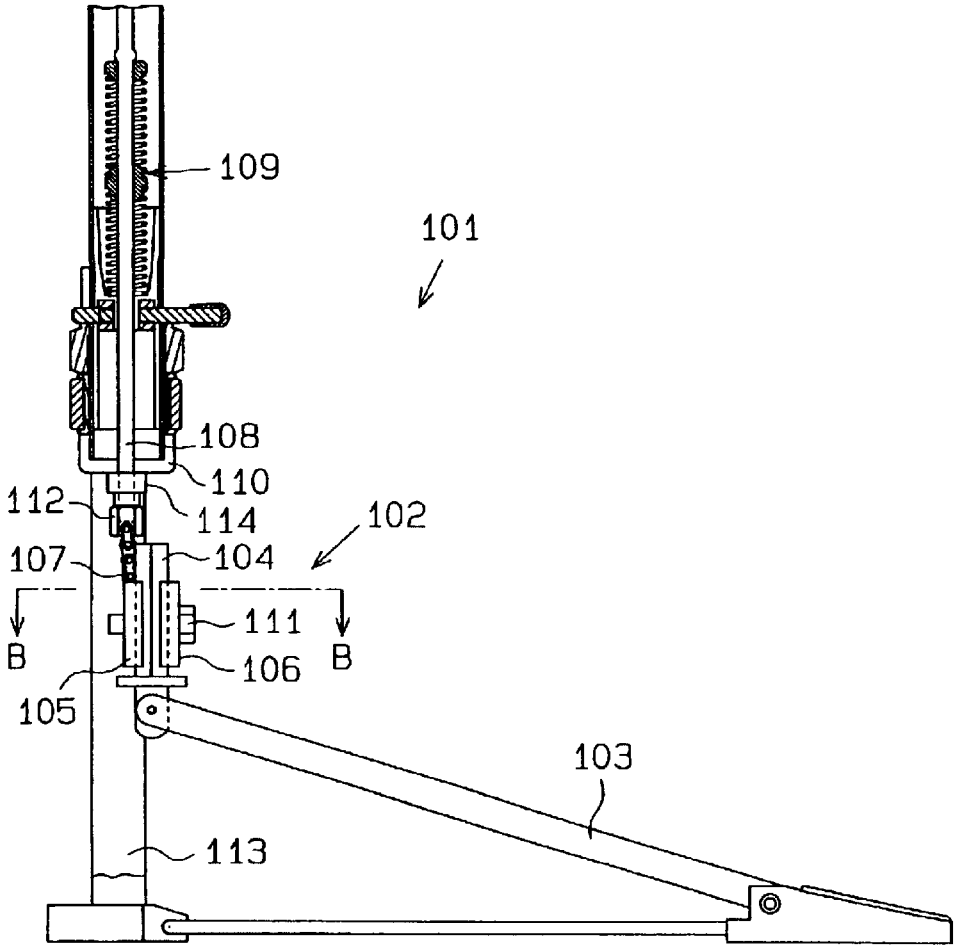
Fig.8 (Prior Art)
FIG. 8 is a cross-sectional view showing a first example of a prior art high hat stand.
Figure 9:
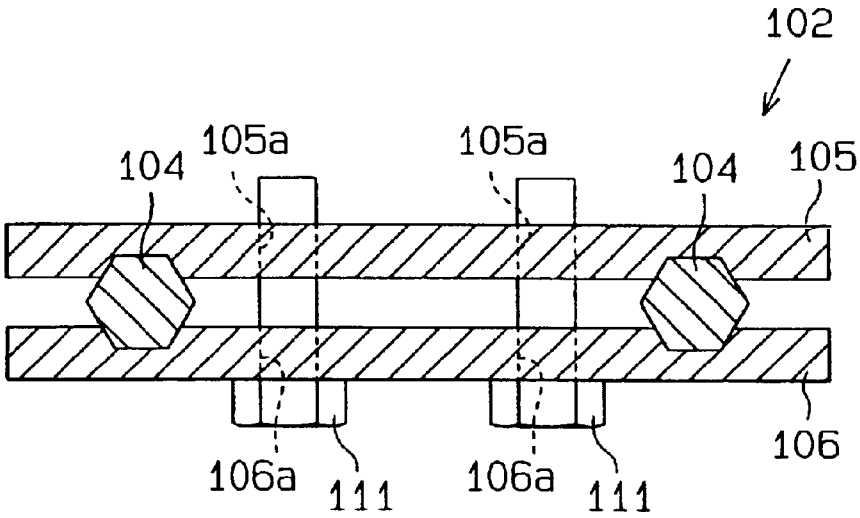
Fig.9(Prior Art)
FIG. 9 is a cross-sectional view taken along line 9—9 in FIG. 8.
Figure 10:
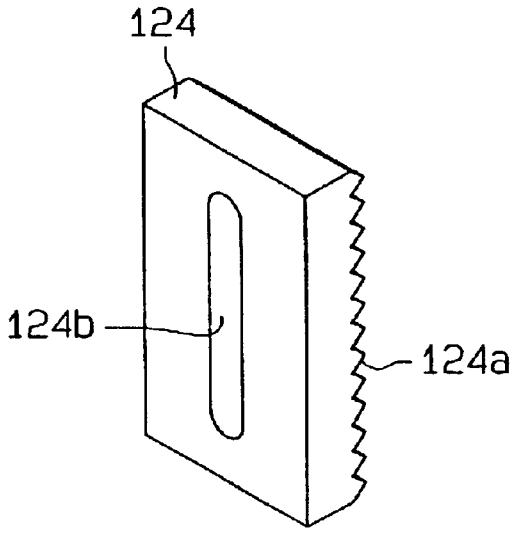
Fig.10(Prior Art)
FIG. 10 is a perspective view showing a height adjustment plate of a second example of a prior art high hat stand.

The operation of the height adjustment mechanism 60 will now be discussed. The knob 81 is arranged at the highest position in the state of FIG. 6. In FIG. 7, the knob 81 is moved downward.

The bolt 76 is first loosened from the nut 75 such that the bolt 76 does not fall out of the nut 75 (unlocking state). The knob 81 is gripped to rotate the movable body 62. The movable body 62 is then moved relative to the threaded sleeve 65 for height adjustment. As shown in the state of FIG. 6, when the knob 81 contacts the fixed body 61, the lower end surface of the knob 81 is located at the highest position.

The uppermost position of the movable range of the shock absorber 55 is determined in accordance with the height of the lower end surface of the knob 81. Adjustment of the position of the knob 81 changes the distance between the shock absorber 55 and the lower pipe 22 and adjusts an initial position of the foot pedal 12 (i.e., the position when the foot pedal 12 is not depressed).

In such manner, when the foot pedal 12 is temporarily positioned at the initial position, the foot pedal 12 is depressed to test the feel (usage state) of the foot pedal 12. In this state, when a load is applied to the height adjustment mechanism 60, the threads of the movable body 62 and the fixed body 61, which extend in a direction perpendicular to the load, prevent the position of the foot pedal 12 from being changed. Such procedure is repeated until adjustment of the initial position of the foot pedal 12 is completed. Then, the bolt 76 and the nut 75 are firmly fastened to each other (locked state). This prevents the rotation of the movable body 62 relative to the fixed body 61 and determines the initial position of the foot pedal 12 (FIG. 7).

The ring 70 clamps the movable body 62. However, since the threaded portion 80*b* is formed by square threads, the clamping does not crush the threads of the threaded portion 80*b*.

The high hat stand 11 of the preferred embodiment has the advantages described below.

(1) The high hat stand 11 includes the temporary positioning mechanism 85, which temporarily positions the foot pedal 12 at a certain height, and a rotation restriction mechanism 78, which locks and unlocks the temporary positioning mechanism 85. Such structure facilitates the testing of the height of the temporarily positioned foot pedal 12. Further, the rotation restriction mechanism 78 maintains such state until the foot pedal 12 is finally positioned.

(2) The meshing amount of the threaded sleeve 65 relative to the threaded portion 80*b* is adjusted by changing the distance between the lower pipe 22 and the shock absorber 55. This temporarily adjusts the height of the foot pedal 12. Accordingly, the nut 75 and bolt 76 do not have to be fastened to each other whenever the height of the foot pedal 12 is adjusted, and the height adjustment of the foot pedal 12 is facilitated.

Figure 11:
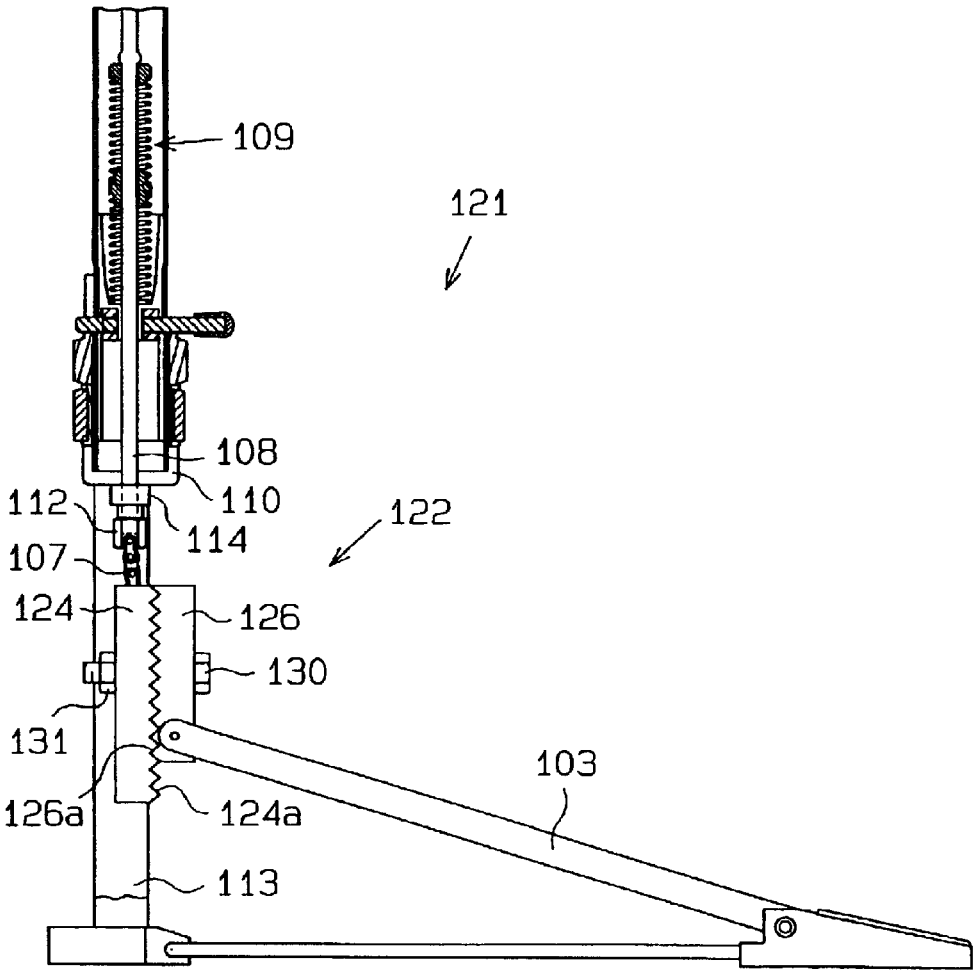
Fig.11 (Prior Art)
FIG. 11 is a cross-sectional view of the second example of a prior art high hat stand.

In the second example of the prior art high hat stand 121 shown in FIG. 11, the height of the foot pedal 103 is adjusted in a stepped manner in accordance with the meshed positions of the serrated surfaces 124*a*, 126*a* of the height adjustment plates 124, 126. Thus, the foot pedal 103 may not be adjusted at the desired height. In comparison, the high hat stand 11 adjusts the height of the threaded sleeve 65 and the threaded portion 80*b* in a non-stepped manner. More specifically, the height of the lower end surface of the knob 81 changes gradually in accordance with the rotated amount of the knob 81. This enables linear and fine adjustment. In addition, the force of the spring 50 does not change the height of the movable body 62. Thus, the temporary adjustment is facilitated.

(3) In the preferred embodiment, the bolt 76 and the nut 75 are loosened to allow the rotation of the movable body 62 relative to the fixed body 61. On the other hand, the bolt 76 and the nut 75 are rigidly fastened to each other to narrow the clearance C. This clamps the movable body 62 (the tightening portion 80*a* or the threaded portion 80*b*) with the ring 70. Accordingly, the foot pedal 12 is locked at a temporarily positioned height with a simple structure.

(4) The threaded sleeve 65 and the clamp 66 are formed integrally with each other. Thus, the threaded sleeve 65 and the clamp 66 do not have to be formed separately, and the threaded sleeve 65 and the clamp 66 do not have to be separately fixed to the gate frame 20. This reduces the number of components and the number of assembling steps.

(5) In the preferred embodiment, the knob 81 is formed on the lower end of the shaft 80, and a knurl 81*a* is formed on the outer surface of the knob 81. Accordingly, the movable body 62 is firmly gripped when rotated.

(6) In the high hat stand 101 of the first prior art example, the height adjustment mechanism 102 (i.e., the rod 104 and the rod holding plates 105, 106) is made of metal such as steel. In the high hat stand 121 of the second prior art example, the height adjustment mechanism 122 (i.e., the height adjustment plates 124, 126) is made of metal such as steel. In comparison, in the preferred embodiment, the height adjustment mechanism 60 (i.e., the fixed body 61 and the movable body 62) is made of synthetic resin, which is inexpensive and easily machined. Accordingly, the manufacturing cost of the high hat stand 11 is decreased.

(7) In the preferred embodiment, the threads of the movable body 62 have flat apexes. Accordingly, the threads of the threaded portion 80*b* are not crushed even though the ring 70 clamps the threaded portions 80*b*.

It should be apparent to those skilled in the art that the present invention may be embodied in many other specific forms without departing from the spirit or scope of the invention. Particularly, it should be understood that the present invention may be embodied in the following forms.

Instead of attaching the shock absorber 55 to the operating rod 42, the shock absorber 55 may be attached to the lower end surface of the knob 81.

The shock absorber 55 may be eliminated. In such a case, the nut 41 contacts the lower end of the movable body 62.

The threaded portion 80*b* may be formed by trapezoid or triangular threads.

The knurl 81*a* of the knob 81 may be eliminated.

The fixed body 61 and the movable body 62 may be formed from metal, such as steel.

The threaded sleeve 65 and the clamp 66 may be formed separately.

A nut fastened with the threaded portion 80*b* of the movable body 62 may be used in lieu of the fixed body 61, which includes the ring 70 for clamping the movable body 62. In this case, the threaded sleeve 65 of the fixed body 61 and the nut function as a double nut that fastens the movable body 62.

A threaded hole extending through the wall of the ring 70 may be formed to receive a bolt and fix the movable body 62. In this case, the bolt is fastened to the ring 70 so that the distal end of the bolt contacts the threaded portion 80*b* of the movable body 62. The frictional force produced by the contact restricts the rotation of the movable body 62.

The operating rod 42 does not necessarily have to extend through the fixed body 61 and the movable body 62.

Instead of fixing the threaded sleeve 65 to the gate frame 20, the threaded portion 80*b* may be fixed to the gate frame 20. In such a case, the threaded sleeve 65 is moved relative to the fixed threaded portion 80*b*.

Instead of fixing the threaded sleeve 65 to the gate frame 20, the threaded sleeve 65 may be fixed to the operating rod 42. Alternatively, the threaded portion 80*b* may be fixed to the operating rod 42, and the threaded sleeve 65 may be fastened to the threaded portion 80*b*.

The present examples and embodiments are to be considered as illustrative and not restrictive, and the invention is not to be limited to the details given herein, but may be modified within the scope and equivalence of the appended claims.

What is claimed is:

1. A high hat cymbal stand comprising:

a stand body for supporting a fixed cymbal;

an operation rod connected to the fixed cymbal, the operation rod having a lower portion;

an engaging member fixed to the lower portion of the operation rod;

a pedal connected to the operation rod and operated to move a movable cymbal relative to the fixed cymbal, the pedal having a distal end and a usage status; and an adjustment mechanism arranged between the stand body and the pedal to adjust a height of the distal end of the pedal, wherein the adjustment mechanism includes;

a temporary positioning mechanism for changing a distance between the stand body and the engaging member to temporarily position the distal end of the pedal at a certain height; and a lock mechanism for locking and unlocking the temporary positioning mechanism, wherein the usage status of the pedal can be tested at the certain height when the temporary positioning mechanism is in an unlocked state.

2. The high hat stand according to claim 1, wherein height adjustment of the distal end of the pedal is prohibited when the temporary positioning mechanism is locked, and the height adjustment of the distal end of the pedal is permitted when the temporary positioning mechanism is unlocked, the height of the distal end of the pedal being adjusted by operating the temporary positioning mechanism.

3. The high hat stand according to claim 1, wherein the stand body includes:

a pipe unit through which the operation rod extends, wherein the lower portion of the operation rod is arranged below a lower end of the pipe unit; and a connecting member for connecting the operation rod and the pedal, wherein the temporary positioning mechanism includes:

a female thread member fixed to the pipe unit coaxially with the operation rod; and a male thread member fastened to the female thread member, wherein the distance between the pipe unit and the engaging member is changed in accordance with the relative position between the male thread member and the female thread member to adjust the height of the distal end of the pedal.

4. The high hat stand according to claim 3, wherein the lock mechanism is a rotation restriction mechanism for prohibiting relative rotation between the male thread member and the female thread member.

5. The high hat stand according to claim 4, wherein the rotation restriction mechanism is fixed to the stand body and clamps the male thread member to prohibit rotation of the male thread member.

6. The high hat stand according to claim 3, wherein the lock mechanism includes a pair of clamping plates formed integrally with the female thread body.

7. The high hat stand according to claim 3 further comprising an urging member arranged between the pipe unit and the operation rod, wherein the urging member urges the operation rod upward.

8. The high hat stand according to claim 3, wherein the male thread member includes a knob formed integrally with the male thread member.

9. A high hat cymbal stand comprising:

a stand body for detachably supporting a fixed cymbal;

an operation rod connected to the fixed cymbal, the operation rod having a lower portion;

an engaging member fixed to the lower portion of the operation rod;

a pedal connected to the operation rod and operated to move a movable cymbal relative to the fixed cymbal, wherein the pedal is attached to the stand body and is moved within a stroke defined by an initial position in which the fixed cymbal and the movable cymbal are separated from each other and an operation position in which the fixed cymbal and the movable cymbal contact each other, the pedal having a usage status; and an adjustment mechanism attached to the stand body to adjust an initial position of the pedal and change the stroke, wherein the adjustment mechanism includes;

a temporary positioning mechanism operated to temporarily position the pedal at the initial position by changing a distance between the stand body and the engaging member; and a lock mechanism operated to lock the temporary positioning mechanism, wherein the operation of the temporary positioning mechanism is prohibited when the temporary positioning mechanism is locked, and the operation of the temporary positioning mechanism is permitted when the temporary positioning mechanism is unlocked, the initial position of the pedal being adjusted by operating the temporary positioning mechanism, wherein the usage status of said pedal can be tested at said adjusted initial position when the temporary positioning mechanism is in an unlocked state.

10. The high hat stand according to claim 9, wherein the temporary positioning mechanism includes:

a female thread member fixed to the pipe unit coaxially with the operation rod; and a male thread member fastened to the female thread member and contacted with the engaging member when the pedal is arranged at the initial position, wherein the length of the temporary positioning mechanism along the operation rod is changed by rotating the male thread member.

11. The high hat stand according to claim 10, wherein the male thread member is rotated to change the distance between the male thread member and the pedal.

12. The high hat stand according to claim 10, wherein the lock mechanism includes a pair of clamping plates formed integrally with the male thread body and a bolt for restricting the rotation of the male thread member.

13. A high hat cymbal stand comprising:

a stand body for supporting cymbal;

a pedal operated to move the cymbal; and an adjustment mechanism arranged between the stand body and the pedal to adjust the height of a distal end of the pedal, wherein the adjustment mechanism includes;

a temporary positioning mechanism for temporarily positioning the distal end of the pedal at a certain height; and a lock mechanism for locking and unlocking the temporary positioning mechanism, wherein a usage status of said pedal can be tested at the certain height when the temporary positioning mechanism is in an unlocked state, the stand body including:

an operation rod connected to the cymbal and moved in cooperation with the operation of the pedal;

a pipe unit through which the operation rod extends, wherein the operation rod has a lower portion arranged below a lower end of the pipe unit;

an engaging member fixed to the lower portion of the operation rod; and a connecting member for connecting the operation rod and the pedal, the temporary positioning mechanism including:

a female thread member fixed to the pipe unit coaxially with the operation rod; and a male thread member fastened to the female thread member, wherein the distance between the pipe unit and the engaging member is changed in accordance with the relative position between the male thread member and the female thread member to adjust the height of the distal end of the pedal.

14. The high hat stand according to claim 13, wherein the lock mechanism is a rotation restriction mechanism for prohibiting relative rotation between the male thread member and the female thread member.

15. The high hat stand according to claim 14, wherein the rotation restriction mechanism is fixed to the stand body and clamps the male thread member to prohibit rotation of the male thread member.

16. The high hat stand according to claim 13, wherein the lock mechanism includes a pair of clamping plates formed integrally with the female thread body.

17. The high hat stand according to claim 13 further comprising an urging member arranged between the pipe unit and the operation rod, wherein the urging member urges the operation rod upward.

18. The high hat stand according to claim 13, wherein the male thread member includes a knob formed integrally with the male thread member.

19. A high hat cymbal stand comprising:

a stand body for detachably supporting two cymbals;

a pedal attached to the stand body and moved within a stroke defined by an initial position in which the two cymbals are separated from each other and an operation position in which the two cymbals contact each other; and an adjustment mechanism attached to the stand body to adjust the initial position of the pedal and change the stroke, the adjustment mechanism including;

a temporary positioning mechanism operated to temporarily position the pedal at the initial position; and a lock mechanism operated to lock the temporary positioning mechanism, wherein the operation of the temporary positioning mechanism is prohibited when the temporary positioning mechanism is locked, and the operation of the temporary positioning mechanism is permitted when the temporary positioning mechanism is unlocked, the initial position of the pedal being adjusted by operating the temporary positioning mechanism, wherein a usage status of said pedal can be tested at said adjusted initial position when the temporary positioning mechanism is in an unlocked state wherein the stand body includes:

an operation rod for transmitting the operation of the pedal to the cymbals; and an engaging member fixed to a lower portion of the operation rod, wherein the temporary positioning mechanism includes:

a female thread member fixed to the pipe unit coaxially with the operation rod; and a male thread member fastened to the female thread member and contacted with the engaging member when the pedal is arranged at the initial position, wherein the length of the temporary positioning mechanism along the operation rod is changed by rotating the male thread member.

20. The high hat stand according to claim 19, wherein the male thread member is rotated to change the distance between the male thread member and the pedal.

21. The high hat stand according to claim 19, wherein the lock mechanism includes a pair of clamping plates formed integrally with the male thread body and a bolt for restricting the rotation of the male thread member.

* * * * *